US006422910B1

(12) United States Patent
Takaya

(10) Patent No.: US 6,422,910 B1
(45) Date of Patent: Jul. 23, 2002

(54) JELLYFISH TYPE UNDERWATER SWIMMING TOY

(75) Inventor: Motoki Takaya, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 09/694,598

(22) Filed: Oct. 23, 2000

(30) Foreign Application Priority Data

Jul. 18, 2000 (JP) ..... 2000-217890

(51) Int. Cl.[7] ..... A63H 23/10
(52) U.S. Cl. ..... 446/139; 446/156; 446/486
(58) Field of Search ..... 446/153, 155, 446/156, 158, 159, 298, 129, 137, 139, 486, 487, 489

(56) References Cited

U.S. PATENT DOCUMENTS 4,579,540 A * 4/1986 Ho ..... 446/137
4,713,037 A 12/1987 Tong
4,832,650 A 5/1989 Tong
5,030,161 A * 7/1991 Pastor ..... 446/298

FOREIGN PATENT DOCUMENTS

WO 9111235 8/1991

* cited by examiner

*Primary Examiner*—Jacob K. Ackun
(74) *Attorney, Agent, or Firm*—Price and Gess

(57) ABSTRACT

A jellyfish type underwater swimming toy capable of exhibiting reality sufficient to permit an observer to be impressed as if a jellyfish swims in a fluttering manner under water. A toy body is formed into a jellyfish-like shape and includes a head. The head includes a head body, a plurality of swing arms radially arranged on a periphery of the head body in a manner to be vertically swingable, and an umbrella-like member formed into a configuration like a thin film and arranged on the head body and swing arms. Thus, when the swing arms are swingably moved through a drive mechanism, the umbrella-like member is vertically actuated through the swing arms, resulting in the toy swimming in the water while vertically traveling in a fluttering manner.

18 Claims, 3 Drawing Sheets

[Fig. 1]
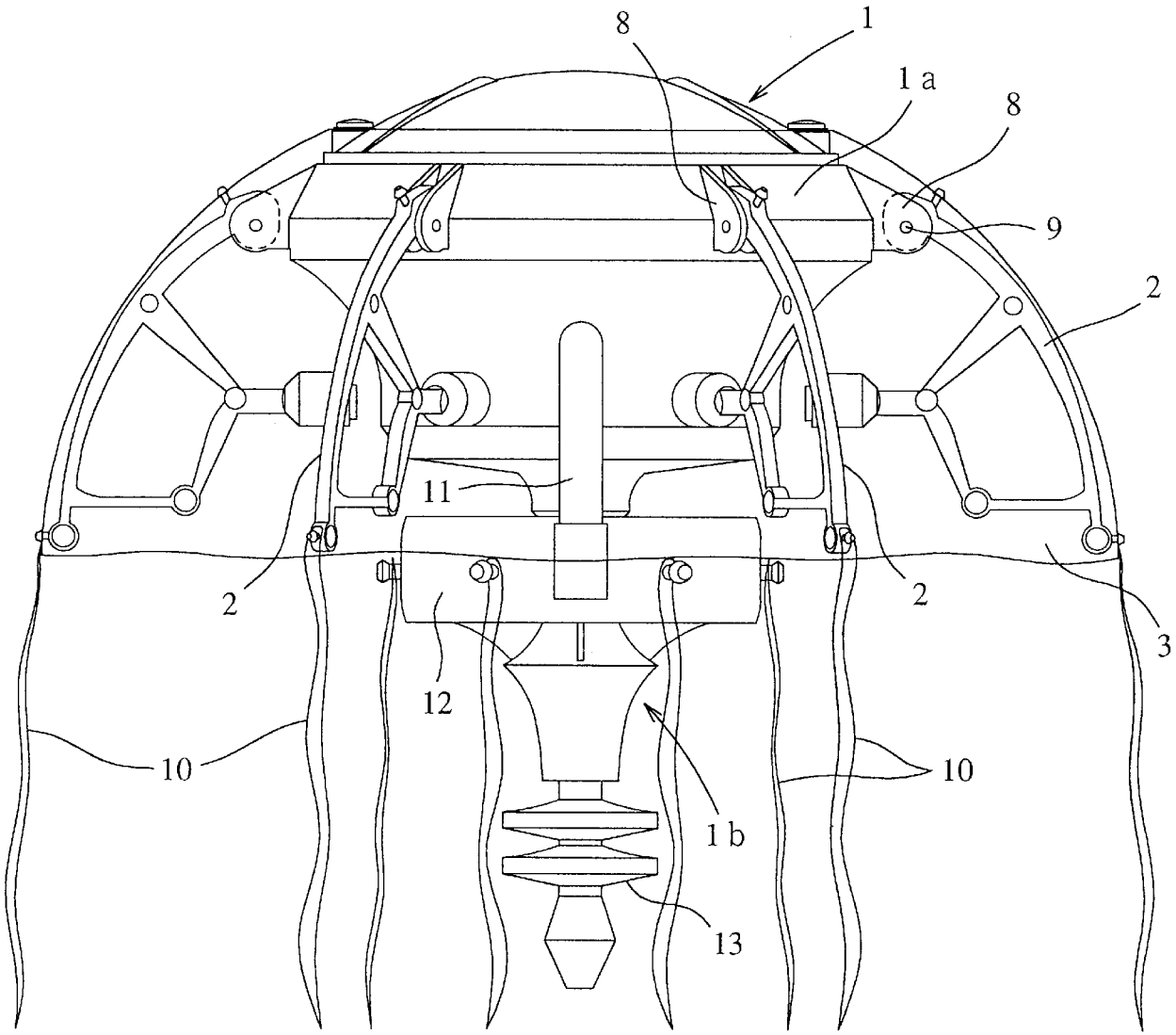

[Fig. 2]
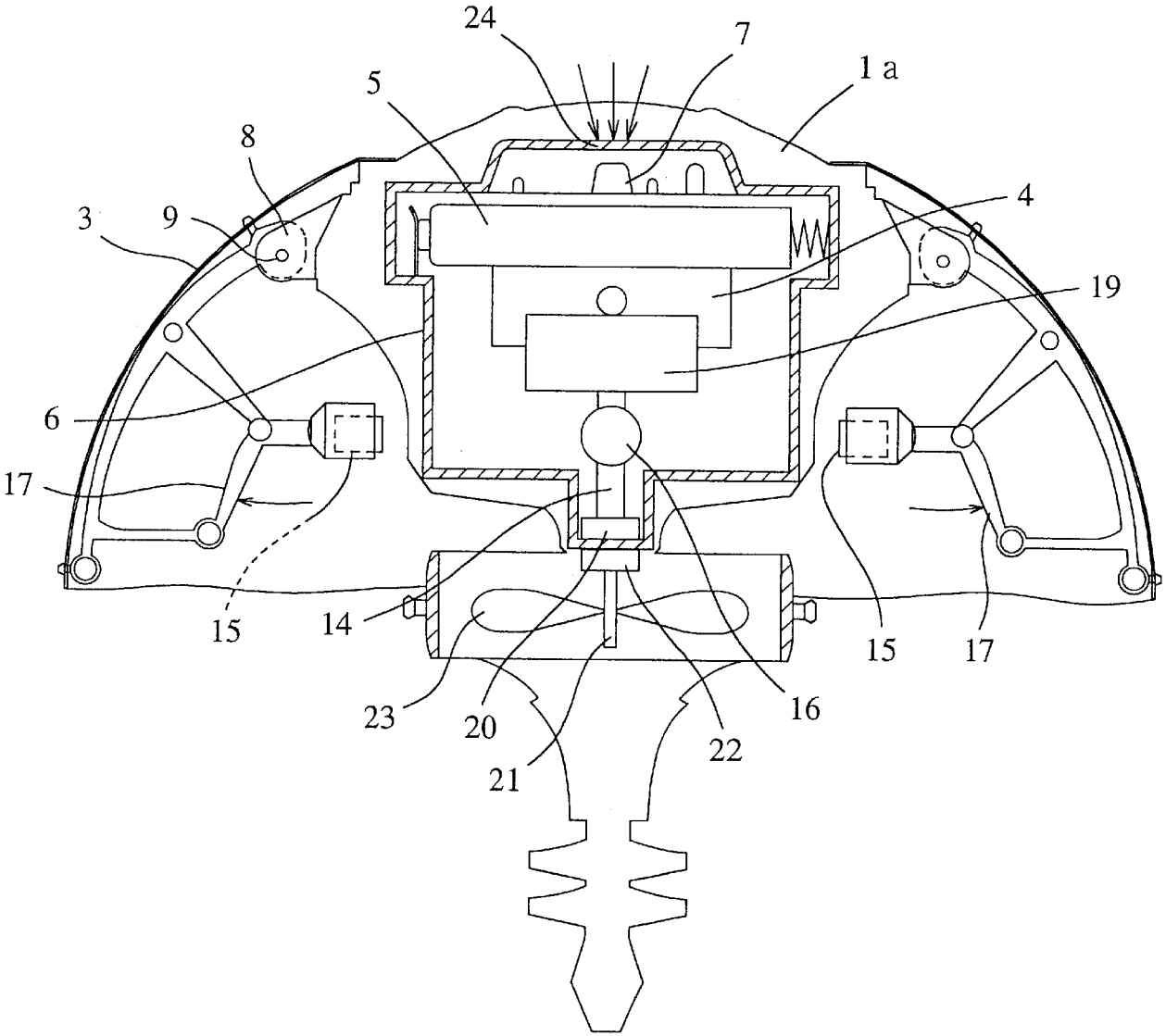

[Fig. 3]
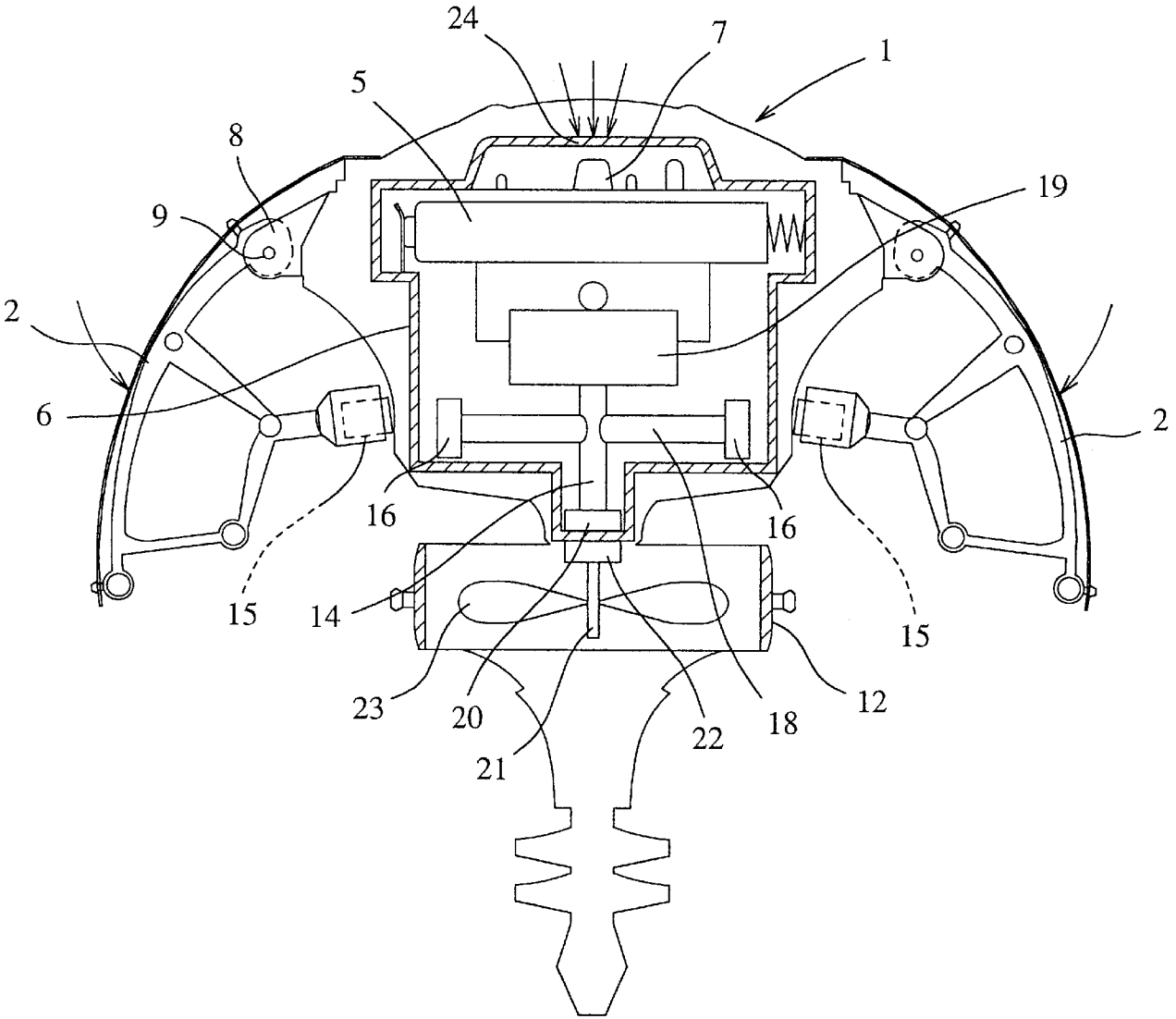

JELLYFISH TYPE UNDERWATER SWIMMING TOY

BACKGROUND OF THE INVENTION

1. Field of the Invention

This invention relates to a jellyfish type underwater swimming toy, and more particularly to a jellyfish type swimming toy which is constructed so as to carry out a jellyfish-like swimming operation under water.

2. Description of the Prior Art

In general, a battery or cell has been conventionally used as a power supply for a toy, because it may be readily used without requiring a cable or the like and permit replacement thereof to be facilitated. However, when a cell is to be incorporated in an underwater swimming toy such as a jellyfish type underwater swimming toy, it is required to provide a watertight means for isolating the cell from water. Also, a cell exhibits increased electric power as compared with a solar panel, thus, use of a cell for the toy requires arrangement of any reduction means. Unfortunately, this causes movement of the toy to be mechanical or unnatural. In addition, it also required to isolate a motor connected to the cell and the reduction means from water. Thus, in the conventional underwater swimming toy, it is necessarily required to use a solar panel (solar cell) as a power supply for the toy.

Unfortunately, a solar panel fails to satisfactorily provide electric power at a sufficient level unless it is exposed to light at highly increased intensity. In order to overcome the problem, it is required to construct the toy into a large-scaled structure.

SUMMARY OF THE INVENTION

The present invention has been made in view of the foregoing disadvantage of the prior art.

Accordingly, it is an object of the present invention to provide a jellyfish type underwater swimming toy which is capable of exhibiting fluttering motion as provided by a real jellyfish while having a dry cell which acts as a power supply incorporated therein.

In accordance with the present invention, a jellyfish type underwater swimming toy is provided. The toy of the present invention includes a toy body generally formed into a jellyfish-like shape and including a head. The head includes a head body, a plurality of pivotal or swinging arms (hereinafter referred to as "swing arms" radially arranged on a periphery of the head body in a manner to be vertically swingable, and a thin film member arranged on the head body and swing arms. The head is provided therein with a drive mechanism for vertically moving the thin film member. The head body is provided therein with a receiving section. The receiving section is provided therein with a motor for actuating the drive mechanism and means for receiving a dry cell for actuating the motor received in the receiving section.

In a preferred embodiment of the present invention, the drive mechanism is constituted by first permanent magnets each arranged on each of the swing arms and second permanent magnets arranged so as to be rotated with a revolving shaft operatively connected to the motor. The second permanent magnets are arranged in the receiving section. The first and second permanent magnets are so arranged that poles thereof opposite to each other face each other.

In a preferred embodiment of the present invention, the receiving section is formed with a transparent portion. The transparent portion has a photosensor for actuating the motor arranged therein.

In a preferred embodiment of the present invention, the motor is controlled so as to be rotated intermittently rather than continuously.

In a preferred embodiment of the present invention, the toy further includes a revolving shaft for the motor arranged in the receiving section and a drive shaft arranged outside the receiving section. The revolving shaft and drive shaft are arranged coaxially with each other. The revolving shaft and drive shaft are securely mounted on an end thereof with permanent magnets, which are arranged opposite to each other so as to magnetically attract each other with a wall of the receiving section being interposed therebetween.

BRIEF DESCRIPTION OF DRAWINGS

These and other objects and many of the attendant advantages of the present invention will be readily appreciated as the same becomes better understood by reference to the following detailed description when considered in connection with the accompanying drawings; wherein:

FIG. 1 is a front elevation view showing an embodiment of a jellyfish type underwater swimming toy according to the present invention;

FIG. 2 is a fragmentary sectional view showing an essential part of the jellyfish type underwater swimming toy shown in FIG. 1, wherein each of swing arms of an umbrella-like member is at an upper position; and FIG. 3 is a fragmentary sectional view showing an essential part of the jellyfish-type underwater swimming toy shown in FIG. 1 wherein each of swing arms of an umbrella-like member is downwardly pivotally moved.

DETAILED DESCRIPTION OF THE PREFERRED EMBODIMENT

Now, a jellyfish or coelenterate type underwater swimming toy according to the present invention will be described hereinafter with reference to the accompanying drawings.

Referring to FIGS. 1 to 3, an embodiment of a jellyfish type underwater swimming toy according to the present invention is illustrated. A jellyfish type underwater swimming toy of the illustrated embodiment includes a toy body which is generally formed into a jellyfish-like configuration.

The toy body generally includes a head 1 and a trunk 1*b* arranged on a lower side of a central portion of the head 1. The head 1 includes a head body la, a plurality of swing arms 2 swingably or pivotably arranged on a periphery of the head body 1*a* in a manner to radially outwardly extend therefrom and be pivotally moved in a vertical direction, and an umbrella-like member 3 formed into a configuration like a thin film and arranged on the head body la and swing arms 2.

The head body la has a transparent upper surface formed into a convex or dome-like shape. The head body 1*a,* as shown in FIGS. 2 and 3, is provided therein with a receiving section 6, in which a motor 4 and a dry cell 5 for actuating the motor 4 are arranged. The receiving section 6 is water-tightly constructed and more specifically sealedly formed so as to prevent water from intruding thereinto. The receiving section 6 is water-tightly provided with an opening (not shown) for replacement of the dry cell 5. The opening is water-tightly covered with a lid. The receiving section 6 has an upper portion formed to be transparent and is provided therein with a photosensor 7. The photosensor 7 is eclectically connected to an electric circuit having the dry cell 5 and motor 4 incorporated therein. The electric circuit has a feeble current constantly flowed therethrough, to thereby be kept standing by, so that detection of light by the photosensor 7 permits rotation of the motor 4. The motor 4 is controlled so as to rotate intermittently rather than continuously.

The head body 1*a* is preferably provided with an air chamber in proximity to the receiving section 6 so as to act as an air bladder.

The umbrella-like member 3 is fixed at an inner edge thereof to an outer edge of an upper portion of the head body 1*a*. Also, the umbrella-like member 3 is fixed at an outer edge thereof to the swing arms 2 arranged on the periphery of the head body 1*a*.

The head body 1*a,* as shown in FIG. 1, is provided on an outer periphery thereof with plural pairs of bearing members 8 in a manner to be spaced from each other at equal intervals in a circumferential direction thereof. The swing arms 2 each are arranged between each pair of bearing members 8 mounted on the head body 1*a*. Also, the swing arms 2 each are pivotally supported between the bearing members 8 in each pair through a support shaft 9 arranged so as to extend between the bearing members 8. Further, the swing arms 2 each are constantly upwardly urged by elasticity or resiliency of the umbrella-like member 3.

The swing arms 2 each have a leg section 10 attached to a distal end thereof.

The trunk 1*b* is connected to a side surface of the head body 1*a* through a support rod 11. The trunk 1*b* includes an annular ring member 12 and a weight 13 arranged on a lower side of the ring member 12. Additional legs 10 are mounted on an outer periphery of the ring member 12. The weight 13 is constructed so as to permit the whole toy to slowly sink in water when it is released from actuation.

The receiving section 6 is provided therein with a revolving shaft 14, which is then connected to an output shaft of the motor 4. The receiving section 6 is also provided therein with a reduction unit 19, which is operatively connected between the output shaft of the motor 4 and the revolving shaft 14. The revolving shaft 14 is arranged so as to be positioned at a central portion of the head body 1*a*.

The head 1 is provided with a drive mechanism which is constructed so as to vertically pivotally move the umbrella-like member 3. The drive mechanism, as shown in FIGS. 2 and 3, includes a first permanent magnet 15 provided on each of the swing arms 2 and second permanent magnets 16 arranged so as to be rotated with the revolving shaft 14.

The first permanent magnets 15 each are mounted on each of the swing arms 2 through a link-like member 17 fixed on an inside of each of the swing arms 2.

The second permanent magnets 16 are securely mounted on both ends of a rod-like holder 18 which is securely connected at a central portion thereof to the revolving shaft 14 so as to extend through the revolving shaft 14 while being perpendicular thereto.

The first permanent magnets 15 and second permanent magnets 16 are arranged in such a manner that magnetic poles thereof opposite to each other face each other with a side wall of the receiving section 6 being interposed therebetween. Such arrangement of the permanent magnets 15 and 16 permits the first and second permanent magnets to magnetically attract each other.

The revolving shaft 14 is mounted on a lower end thereof with a donut-shaped permanent magnet 20. The receiving section 6 is mounted on an outer surface of a lower portion thereof with a drive shaft 21 in a manner to be coaxial with the revolving shaft 14. The drive shaft 21 is fixedly mounted on an upper end thereof with a donut-shaped permanent magnet 22. The donutshaped permanent magnets 20 and 22 are arranged opposite to each other so as to permanently attract each other. Thus, rotation of the revolving shaft 14 in the receiving section 6 leads to rotation of the drive shaft 21 outside the receiving shaft 6. The drive shaft 21 is mounted thereon with propeller blades 23. The propeller blades 23 are positioned in the ring 12 of the trunk 1*b*.

Now, the manner of operation of the jellyfish type underwater swimming toy thus constructed will be described.

When the jellyfish type underwater swimming toy is placed in water in an aquarium or the like, it permits to slowly sink in the water. Then, when the toy is exposed to light, the photosensor 7 detects the light, so that the motor 4 is rotated by electric power of the dry cell 5. Rotation of the motor 4 is reduced by the reduction unit 19 and then transmitted to the revolving shaft 14, resulting in the revolving shaft 14 and the donut-shaped permanent magnet 20 mounted on the distal end of the revolving shaft 14 being slowly rotated. This permits the donut-shaped permanent magnet 22 arranged outside the receiving section 6 and the drive shaft 21 on which the magnet 22 is fixed to be rotated, leading to rotation of the propeller blades 23. This permits upward driving force to be applied to the jellyfish type underwater swimming toy, resulting in the toy swimming under water.

The motor is rotated intermittently rather than continuously, so that the propeller blades 23 carry out intermittent rotation. This permits the jellyfish type underwater swimming toy to be slowly vertically moved in the water and the umbrella-like member 3 to carry out intermittent movement, so that the toy may carry out realistic motion full of variety.

Rotation of the revolving shaft 14 leads to concurrent rotation of the rod-like holder 18, so that the second permanent magnets 16 mounted on both ends of the rod-like holder 18 may be rotated about the revolving shaft 14, to thereby be moved along an inner peripheral surface of the side wall of the receiving section 6. Such movement of the second permanent magnets 16 permits the second permanent magnets 16 to successively repeat approach and separation with respect to the first permanent magnets 15 on the swing arms 2 arranged opposite thereto through the receiving section 6. When the second permanent magnets 16 approach the first permanent magnets 15, the first permanent magnets 15 are magnetically attracted by the second permanent magnets 16, so that the swing arms 2 may be downwardly pivotally moved as shown in FIG. 3. Then, when the second permanent magnets 16 are moved apart from or separated from the first permanent magnets 15, magnetic attraction between the first and second permanent magnets 15 and 16 is diminished or lost, resulting in the swing arms 2 being upwardly pivotally moved as shown in FIG. 2. Separation of each of the second permanent magnets 16 from the first permanent magnet 15 means approach of the second permanent magnet 16 to the next first permanent magnet 15, so that the next swing arm 2 may be downwardly pivotally moved. Thus, the swing arms 2 are permitted to be vertically pivotally moved in order, so that the jellyfish type underwater swimming toy of the illustrated embodiment may carry out motion which permits an observer to be impressed as if a jellyfish flutteringly swims in the water.

In addition, the motor 4 is controlled so as to be intermittently actuated, to thereby reduce consumption of electric power provided by the dry cell 5.

As can be seen from the foregoing, the jellyfish type underwater swimming toy of the present invention is so constructed that the toy body of the toy is formed into a jellyfish-like shape and the swing arms are moved to vertically actuate the umbrella-like member, resulting in the toy swimming in the water while vertically traveling in a fluttering manner. Thus, the swimming toy exhibits reality sufficient to permit an observer to be impressed as if a jellyfish swims in the water in a fluttering manner. Such fluttering swimming of the toy provides an observer with a soothing effect or relaxation. Also, in the present invention, the drive mechanism is actuated by the dry cell, to thereby eliminate a necessity of arranging any lighting unit as in a solar panel, so that the toy of the present invention may be constructed in a compact manner.

Also, the present invention may be so constructed that rotation of the second permanent magnets arranged in the watertight receiving section permits the swing arms to be pivotally moved through the first permanent magnets arranged outside the receiving section and magnetically actuated by the rotation of the second permanent magnets, leading to fluttering movement of the umbrella-like member. Thus, when the receiving section is formed so as to be opaque, an observer is impressed as if the umbrella-like member is automatically moved, so that an observer's fresh surprise may be aroused.

Further, in the present invention, the motor may be actuated through detection of light by the photosensor, to thereby eliminate actuation of the motor by means of a mechanical switch. This permits water-tightness of the receiving section to be further enhanced.

In addition, the motor may be controlled so as to be rotated intermittently rather than continuously. This significantly reduces consumption of electric power provided by the dry cell.

Moreover, the toy of the present invention may be so constructed that the revolving shaft arranged outside the watertight receiving section is rotated by means of the motor arranged in the watertight receiving section. This effectively prevents short-circuiting of the motor due to wetting of the motor by water during operation of the toy.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A jellyfish type underwater swimming toy comprising:

a toy body generally formed into a shape to simulate a jellyfish;

said toy body including a head portion;

said head portion including a head body, a plurality of swing arms radially arranged on a periphery of said head body in a manner to be vertically swingable, a thin film member arranged on said head body and said swing arms and a drive mechanism for vertically moving said thin film member;

said head body being provided therein with a receiving section;

said receiving section being provided therein with a motor for actuating said drive mechanism and means for receiving a dry cell for actuating said motor.

2. A jellyfish type underwater swimming toy as defined in claim 1, wherein said drive mechanism is constituted by first permanent magnets each arranged on each of said swing arms and second permanent magnets arranged so as to be rotated with a revolving shaft operatively connected to said motor;

said second permanent magnets being arranged in said receiving section;

said first and second permanent magnets being so arranged that poles thereof opposite to each other face each other.

3. A jellyfish type underwater swimming toy as defined in claim 1, wherein said receiving section is formed with a transparent portion;

said transparent portion having a photosensor for actuating said motor arranged therein.

4. A jellyfish type underwater swimming toy as defined in claim 1, wherein said motor is controlled so as to be rotated intermittently rather than continuously.

5. A jellyfish type underwater swimming toy as defined in claim 1, further comprising a revolving shaft for said motor arranged in said receiving section and a drive shaft arranged outside said receiving section;

said revolving shaft and drive shaft being arranged coaxially with each other;

said revolving shaft and drive shaft being securely mounted on an end thereof with permanent magnets, which are arranged opposite to each other so as to magnetically attract each other with a wall of said receiving section being interposed therebetween.

6. A simulated marine coelenterate comprising:

a body member having a source of power, the body member having a semi-spherical configuration with a plurality of swing arms at its periphery, each swing arm mounted for movement to retract toward the body member and to expand away from the body member;

a flexible membrane extending over the respective swing arms to provide an opening below the swing arms; and a motor unit operatively connected to the radial swing arms and source of power to move them to simulate a swimming motion by respectively opening and collapsing the flexible membrane.

7. The invention of claim 6, wherein the body member has a slight negative buoyancy when placed in water.

8. The invention of claim 6, wherein a first magnetic member is operatively connected to at least one radial swing arm.

9. The invention of claim 8, wherein the body member has a second magnetic member operatively moved by the motor unit, the second magnetic member is positioned relative to the first magnetic member to interact with its magnetic field to move the swing arm.

10. The invention of claim 9, wherein a plurality of first magnetic members are respectively connected, one to each swing arm, each swing arm is pivotally connected at an upper portion of the body member, and a plurality of second magnetic members are respectively connected on a holder member and driven by the motor unit to rotate, the holder member and the motor unit are enclosed in a water-tight receiver section that permits the respective magnetic fields to penetrate the receiver section and interact.

11. The invention of claim 10 further including a propeller member operatively extending below the receiver section and movable by the motor unit to move the body member upward in the water.

12. The invention of claim 11, wherein the propeller member is magnetically coupled through the receiver section to the motor unit.

13. The invention of claim 10 further including means for intermittently activating the motor unit.

14. The invention of claim 10 further including a light sensor for detecting light and activating the motor unit.

15. The invention of claim 10, wherein the plurality of swing arms are biased radially outward.

16. The invention of claim 15, wherein the first and second magnetic members have their magnetic poles arranged to attract each other.

17. A simulated marine coelenterate comprising:

a waterproof body member having a source of power;

a plurality of swing arms mounted about a periphery of the body member, each swing arm is pivotally connected to permit a movement away from the body member;

a semi-spherical flexible membrane unit attached to the swing arms to provide an opening between the body member and the flexible membrane; and a motor unit operatively connected to the source of power and the swing arms to cyclically open and collapse the flexible membrane unit to provide a propulsion force when in water to propel the simulated marine coelenterate.

18. The invention of claim 17 further including a propeller member operatively extending from the body member below the swing arms.

* * * * *